US005794594A

United States Patent [19]

Fehlmann

[11] Patent Number: 5,794,594

[45] Date of Patent: Aug. 18, 1998

[54] FUEL INJECTION PUMP

[75] Inventor: Wolfgang Fehlmann, Stuttgart, Germany

[73] Assignee: Robert Bosch GmbH, Stuttgart, Germany

[21] Appl. No.: 817,976

[22] PCT Filed: Mar. 29, 1996

[86] PCT No.: PCT/DE96/00612

§ 371 Date: Apr. 28, 1997

§ 102(e) Date: Apr. 28, 1997

[87] PCT Pub. No.: WO97/08454

PCT Pub. Date: Mar. 6, 1997

[30] Foreign Application Priority Data

Aug. 30, 1995 [DE] Germany ..... 195 31 811.0

[51] Int. Cl.[6] ..... F02M 37/04; F04B 11/00

[52] U.S. Cl. ..... 123/450; 123/495; 417/366; 417/543

[58] Field of Search ..... 123/450, 495, 123/449; 417/369, 543, 366

[56] References Cited

U.S. PATENT DOCUMENTS

| | | | |
|---|---|---|---|
| 4,573,442 | 3/1986 | Matsumura | 123/450 |
| 4,601,274 | 7/1986 | Seilly | 123/450 |
| 4,625,694 | 12/1986 | Adey | 123/450 |
| 4,691,679 | 9/1987 | Lakin | 123/450 |
| 4,879,029 | 11/1989 | Whitehead | 417/543 |
| 4,948,346 | 8/1990 | Tuckey | 417/543 |
| 5,219,277 | 6/1993 | Tuckey | 417/543 |
| 5,285,758 | 2/1994 | Fiedler | 123/495 |
| 5,354,183 | 10/1994 | Eisenbacher | 417/366 |
| 5,413,468 | 5/1995 | Tuckey | 417/366 |

*Primary Examiner*—Carl S. Miller

*Attorney, Agent, or Firm*—Edwin E. Greigg; Ronald E. Greigg

[57] ABSTRACT

A fuel injection pump for internal combustion engines, which includes at least one pump piston driven by a cam drive mechanism to carry out a feed stroke and an intake stroke. The pump includes a fuel filled storage chamber that is under storage pressure and is for aspirating fuel in the intake stroke and for feeding excess fuel at the end of the feed stroke to a tank. A fluid filled drive mechanism chamber under lubrication pressure, contains the cam drive mechanism and is divided from the intake chamber by a movable wall. A vacuum chamber is disposed in the fluid filled drive mechanism chamber in order to damp pressure oscillations in the drive mechanism chamber, the vacuum chamber is at least partially defined by a membrane that is acted upon by the lubrication pressure. The rigidity of the membrane is designed so that its effectiveness comes into play only when there is a pressure load that is slightly greater than the stationary lubrication pressure in the drive mechanism chamber (22).

7 Claims, 2 Drawing Sheets

FUEL INJECTION PUMP

PRIOR ART

The invention is based on a fuel injection pump, in particular a distributor injection pump for internal combustion engines.

A fuel injection pump of this kind is disclosed in EP 0 633 398 A1. The movable wall which divides the storage chamber from the drive mechanism chamber and can be embodied as a membrane or as a movable piston, is used to reduce the sudden loading of the storage chamber by the fuel, which has been previously brought to injection pressure and is sent into the storage chamber at the end of the feed stroke that effects the injection, by virtue of the fact that the movable wall yields to the pressure surge against the drive mechanism chamber, which is under a lower pressure, and offsets the outflow quantity. At the same time, during the intake stroke of the pump piston, the filling process of the pump work chamber is positively supported by the simultaneous volume change in the intake chamber and drive mechanism chamber. The pressure difference in the storage chamber and the drive mechanism chamber, which acts on this pump piston during its intake stroke, powers the pump piston in the intake stroke direction and obviates the need for a separate spring for returning the pump piston from its top dead center position to its bottom dead center position after the pressure or filling stroke.

Because of the great pressure difference between the pressure in the storage chamber (storage pressure) and the pressure in the drive mechanism chamber (lubrication pressure), the movable wall is optimally designed only for pressure fluctuations in the storage chamber, but cannot compensate for pressure fluctuations in the drive mechanism chamber, but rather contributes to the development of pressure oscillations in the drive mechanism chamber. The result is cavitations in the lubricating fluid, which leads to incomplete lubrication of the drive mechanism.

ADVANTAGES OF THE INVENTION

The fuel injection pump according to the invention, has the advantage over the prior art that because of the vacuum chamber according to the invention, which is defined by a membrane, pressure oscillations in the drive mechanism chamber owing to compression or expansion of the vacuum chamber can be compensated for, by means of which cavitation is prevented in the drive mechanism chamber and its filling with lubricating fluid is improved. The vacuum chamber is integrated into the fuel injection pump and does not require any additional installation space.

Advantageous improvements and updates of the fuel injection pump are possible by means of measures set forth herein.

According to a preferred embodiment of the invention, the membrane, together with the movable wall, encloses the vacuum chamber wherein the membrane is preferably fastened to the movable wall, which in the case of a metal wall, is carried out by soldering. This has the advantage that because of the soldering process for connecting the metal membrane and the movable metal wall, a vacuum automatically occurs between the two connected pieces when cooling takes place. The tempering of the membrane can be carried out with the soldering process. A structural change of the design of the fuel injection pump is not required since in comparison to series pumps, only the movable wall has to be provided with a membrane.

According to an advantageous embodiment of the invention, the vacuum chamber is enclosed by two shells that rest on each other and are joined to each other at the edges, which together constitute a pressure capsule with two effective membrane surfaces. With this embodiment of the vacuum chamber, the effective work surfaces for the compensation of pressure oscillations are considerably greater due to the double-sided membrane surfaces.

BRIEF DESCRIPTION OF THE DRAWINGS

The invention is explained in detail in the ensuing description in conjunction with preferred embodiments represented in the drawings.

DESCRIPTION OF THE EXEMPLARY EMBODIMENTS

Figure 1:
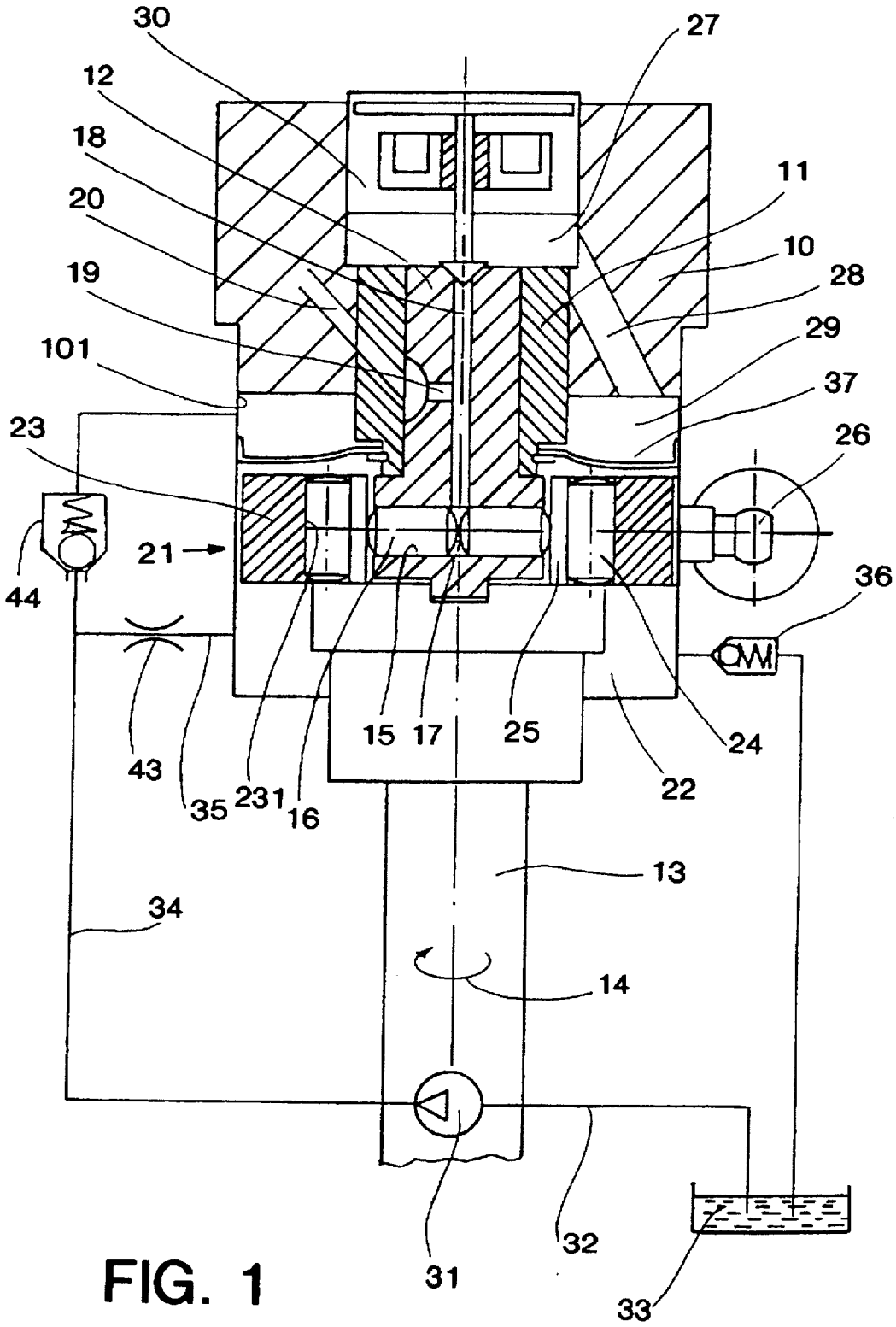
FIG. 1 PRIOR ART
FIG. 1 shows a schematic representation of a longitudinal cross-section through a prior art fuel injection pump, FIGS. 2 and 3 respectively show an enlarged representation of a detail from the fuel injection pump in FIG. 1, in the region of the intake chamber and drive mechanism chamber.

The fuel injection pump, schematically represented in a longitudinal cross-section in FIG. 1, of the radial piston distributor injection pump type for internal combustion engines, has a housing 10 with a cylinder liner 11 inserted in it, in which a fuel distributor 12 rotates, which is driven by a drive shaft 13 in the direction of the arrow 14. Pump pistons 16 are guided so they can move axially in radial pump cylinders 15 inserted into the distributor 12, and enclose a pump work chamber 17 between the pump pistons. The number of pump cylinders 15 and pump pistons 16 depends upon the number of cylinders or combustion chambers of the engine to be supplied by the fuel injection pump. In the course of the rotation of the distributor 12 during the stroke movements of the pump piston 16, the pump work chamber 17 can be successively connected to one of a number of injection lines 20 via an axial conduit 18 in the distributor 12 and via a radial bore 19 branching from it, whose outflow from the distributor 12 is used as a distributor opening, which injection lines are provided in the housing 10 of the fuel injection pump and lead to the individual cylinders or combustion chambers and injection points of the engine that are disposed there.

The pump pistons 16 are driven in their stroke motion by a cam drive mechanism 21, which is disposed in a drive mechanism chamber 22 in the housing 10. The drive mechanism 21 has a cam ring 23 with a cam track 231 aligned radially inward, on which rollers 24 run during the rotation of the distributor 12, which transmit their radial motion to the pump piston 16 via roller tappets 25. The cam ring 23 is essentially fixed and in order to adjust the injection onset, can be adjusted in a known manner via a pin 26, which engages an injection adjusting piston.

On the upper end face of the distributor 12, the axial conduit 18 feeds-into a fuel chamber 27, which communicates with a fuel storage chamber 29 embodied in the housing 10 via a conduit 28 in the housing 10. The discharge of the axial conduit 18 into the fuel chamber 27 is controlled by a solenoid valve 30 in such a way that when the solenoid valve 30 is open during the intake stroke of the pump piston 16, the pump work chamber 17 can be supplied with fuel from the storage chamber 29. At the beginning of the feed stroke of the pump piston 16, the solenoid valve 30 is closed and consequently determines the injection onset and also the duration over which high pressure fuel is delivered from the pump work chamber 17 into the injection line 20 during the feed stroke of the pump piston 16. Injection onset and injection quantity are thus determined by the solenoid valve 30.

In order to supply the storage chamber 29 with fuel, a prefeed pump 31 aspirates fuel from a fuel reservoir 33 via a line 32 and supplies it to the storage chamber 29 via a line 34. A line 35 via which fuel reaches the drive mechanism chamber 22 branches from the line 34. The drive mechanism chamber 22 discharges into the fuel reservoir 33 via a pressure maintenance valve 36, which determines the pressure in the drive mechanism chamber 22. An uncoupling throttle 43 is inserted into the line 35 in order to assure that a pressure can be set in the drive mechanism chamber 22, which is significantly lower than the fuel pressure in the storage chamber 29. The fuel in the drive mechanism chamber 22 is used as a lubricating fluid for the cam drive mechanism 21. In lieu of fuel, another lubricating fluid can be used.

The storage chamber 29 is divided from the drive mechanism chamber 22 by a movable wall 37, which on the one hand, rests sealingly against the cylindrical inner wall 101 of the housing 10 and on the other hand, is sealingly connected to the cylinder liner 11 coaxial to this housing. Because of the great pressure difference between the fuel in the storage chamber 29 (storage pressure) and the fuel in the drive mechanism chamber 22 (lubrication pressure), it is no longer necessary for the pump pistons 16, during their intake stroke, to be pressed against the cam track 231 by springs via the roller tappets 25 and the rollers 24 because the solenoid valve 30 is open during the intake stroke of the pump piston 16 and the storage pressure acts on the piston face of the pump piston 16 that defines the pump work chamber 17, while with an equal area, the pump piston 16 exerts the lubrication pressure on the end face that protrudes into the drive mechanism chamber 22. Because of this pressure difference, the pump pistons 16 are pressed against the roller tappets 25 and in the intake stroke, follow the outwardly directed radial stroke motion of the rollers 24.

In the subsequent feed stroke of the pump pistons 16, in which they are respectively moved radially inward via the rollers 24 and the roller tappets 25, as a result of the opening of the solenoid valve 30 at the end of supply, a part of the fuel delivered by the pump piston 16 is instead fed under high pressure into the injection lines 20 via the conduit 28, back into the storage chamber 29. The movable wall 37 deflects elastically toward the drive mechanism chamber 22 due to the pressure peaks that occur in this way in the storage chamber 29, by means of which on the one hand, the rapid pressure decrease in the pump work chamber 17 is made easier and on the other hand, pressure oscillations that occur in the storage chamber 29 are damped. The movable wall 37, though, is optimally designed only for pressure oscillations in the storage chamber 29 and for its part, because of its deflection toward the drive mechanism chamber 22, in turn generates pressure oscillations in the drive mechanism chamber 22.

The result is cavitations in the fuel inside the drive mechanism chamber 22 and an unfavorable filling of the drive mechanism chamber 22 with fuel, which in extreme cases leads to an insufficient lubrication of the drive mechanism 21. In order to prevent this, a vacuum chamber 38 is disposed in the drive mechanism chamber 22, as is shown in the enlarged detail in FIG. 2, which vacuum chamber is defined by a membrane 39 that is acted upon by the lubrication pressure. The rigidity of the membrane 39 is designed so that it can be moved in the direction of a reduction of the vacuum[]chamber 38 in size only when there is a pressure load that is slightly greater than the stationary lubrication pressure in the drive mechanism chamber 22. This design of the membrane 39 is required so that the vacuum chamber 38 does not fail due to the stationary pressure in the drive mechanism chamber 22.

Figure 2:
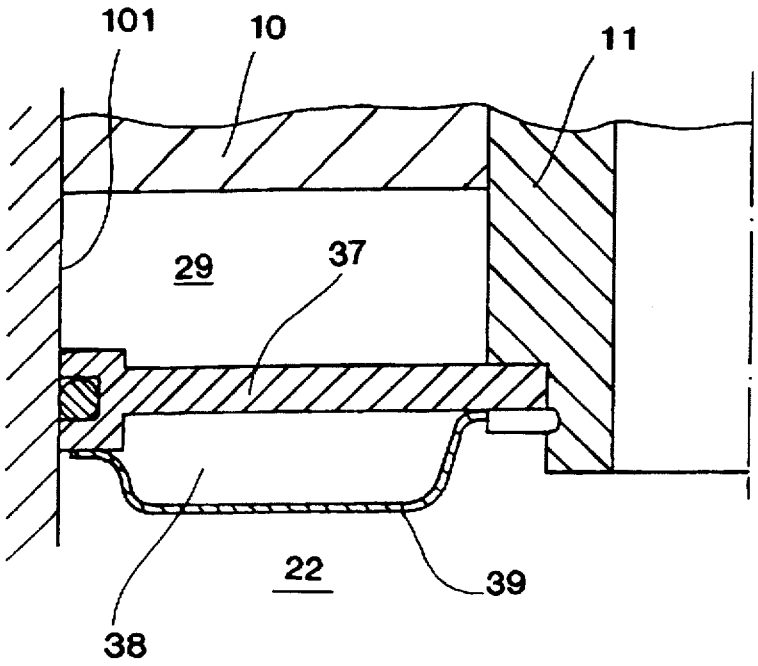

In the example shown in FIG. 2, the vacuum chamber 38 is defined on one side by the movable wall 37 and on the other side by the membrane 39. Preferably, the movable wall 37 and the membrane 39 are made of metal and the membrane 39 is soldered to the movable wall 37. In the soldering process, the rigidity of the membrane 39 can be set and the vacuum automatically occurs in the vacuum chamber 38 after cooling. Pressure oscillations in the fuel inside the drive mechanism chamber 22 are now compensated for by a more or less intense indentation of the membrane 39 into the vacuum chamber 38 or by a flattening of the membrane 39 when the volume of the vacuum chamber 38 is increased. As a result, the cavitations feared are prevented and the filling ratio of the drive mechanism chamber 22 is improved, by means of which on the whole, a very favorable lubrication of the drive mechanism 21 is assured.

Figure 3:
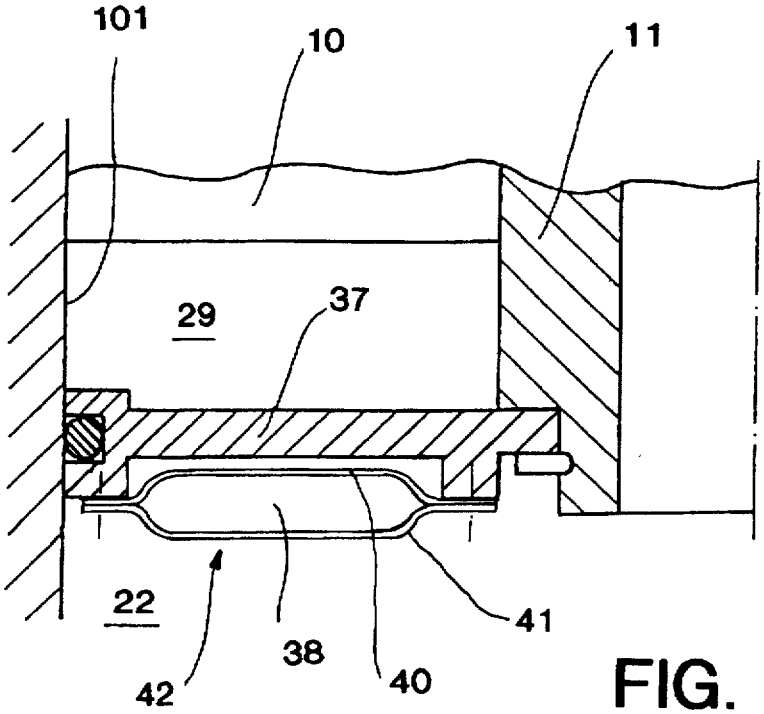

In the exemplary embodiment shown in FIG. 3, the vacuum chamber 38 is enclosed by two shells 40, 41, which rest on each other at their edges and are connected to each other. The two shells 40, 41 constitute a pressure capsule 42 with two effective membrane surfaces. The pressure capsule 42 is attached with its edge to the movable wall 37, wherein attention is paid that the membrane surface pointing toward the movable wall 37 does not bump against the movable wall 37. The pressure capsule 42, though, can also be fastened to other components inside the drive mechanism chamber 22. It is also possible to carry out the fastening of the pressure capsule 42 inside the drive mechanism chamber 22 by clamping it on the edges between two components.

The invention is not limited to the exemplary embodiment described. It can also be useful to integrate a check valve 44 into the line 34 between the prefeed pump 31 and the intake chamber 29, as shown in FIG. 1, which valve is suitably disposed in the section of line after the branching of line 35. This check valve 44 achieves the fact that when the axial conduit 18 is opened by the solenoid valve 30, the pressure in the storage chamber 29 can increase to above the set delivery pressure of the prefeed pump 31 and as a result, at the beginning of the subsequent filling process of the pump work chamber 17, there is a greater pressure difference, which improves the filling of the pump work chamber 17.

The foregoing relates to preferred exemplary embodiments of the invention, it being understood that other variants and embodiments thereof are possible within the spirit and scope of the invention, the latter being defined by the appended claims.

What is claimed and desired to be secured by Letters Patent of the United States is:

1. A fuel distributor injection pump for internal combustion engines, which comprises at least one pump piston (16), which is guided so that it the at least one pump piston moves radially in a pump cylinder (15) and defines a pump work chamber (17) on an end face, a drive mechanism (21), which engages an end of the pump piston (16) remote from the pump work chamber (17) and drives the at least one pump piston (16) to carry out pressure strokes in an axial direction of said at least one pump piston, a drive mechanism chamber (22), said drive mechanism chamber contains the drive mechanism (21) and is filled with a lubricating fluid, a fuel filled storage chamber (29), said storage chamber is divided from the drive mechanism chamber (22) by a movable wall (37), the pump work chamber (17) is filled with fuel from the storage chamber during the execution of intake strokes of the pump piston (16) and into which a partial quantity of injection pressure fuel, which is supplied in the feed stroke, is sent at an end of the feed stroke of the pump piston (16), wherein a fuel pressure in the storage chamber (29) is significantly greater than a lubrication fluid pressure in the drive mechanism chamber (22), and a vacuum chamber (38) is disposed in the drive mechanism chamber (22), said vacuum chamber is at least partially defined by a membrane (39; 40, 41) that is acted upon by the lubrication fluid pressure, and that a rigidity of the membrane (39; 40, 41) is designed so that the membrane deflects toward the vacuum chamber (38) only when there is a pressure load that is slightly greater than the lubrication pressure in the drive mechanism chamber, (22).

2. A pump according to claim 1, in which the membrane (39) together with the movable wall (37), encloses the vacuum chamber (38) and that the membrane (39) is fastened to the movable wall (37).

3. A pump according to claim 2, in which the movable wall (37) and the membrane (39) are comprised of metal and that the membrane (39) is soldered to the movable wall (37) and spaced therefrom along a length thereof.

4. A pump according to claim 1, in which the vacuum chamber (38) is enclosed by two shells (40, 41) joined to each other at their edges, which together constitute a pressure capsule (42) with two effective membrane surfaces.

5. A pump according to claim 4, in which on its edges, the pressure capsule (42) is fastened at the edges to a component of the fuel injection pump.

6. A pump according to claim 5, in which the component is the movable wall (37) between the storage chamber (29) and the drive mechanism chamber (22).

7. A pump according to claim 4, in which the pressure capsule (42) is clamped at the edges between two components of the fuel injection pump.

* * * * *